US009134694B2

(12) United States Patent
Tong et al.

(10) Patent No.: US 9,134,694 B2
(45) Date of Patent: Sep. 15, 2015

(54) IMAGE FORMING APPARATUS INCLUDING GUIDE GROOVES AND A PHOTORECEPTOR CARTRIDGE INCLUDING GUIDE AXLES

(75) Inventors: Zhao Tong, Shanghai (CN); Hejun Du, Shanghai (CN); Ting Ma, Shanghai (CN)

(73) Assignee: RICOH COMPANY, LTD., Tokyo (JP)

( * ) Notice: Subject to any disclaimer, the term of this patent is extended or adjusted under 35 U.S.C. 154(b) by 95 days.

(21) Appl. No.: 13/592,774

(22) Filed: Aug. 23, 2012

(65) Prior Publication Data

US 2013/0051843 A1 Feb. 28, 2013

(30) Foreign Application Priority Data

Aug. 25, 2011 (CN) ..... 2011 1 0244985

(51) Int. Cl.
*G03G 15/00* (2006.01)
*G03G 21/18* (2006.01)

(52) U.S. Cl.
CPC ..... *G03G 21/1853* (2013.01)

(58) Field of Classification Search
CPC ..... G03G 21/1853
USPC ..... 399/107, 111
See application file for complete search history.

(56) References Cited

U.S. PATENT DOCUMENTS

| | | | | |
|---|---|---|---|---|
| 5,930,561 | A * | 7/1999 | Hosokawa et al. | 399/111 |
| 6,088,555 | A * | 7/2000 | Mizuno | 399/111 |
| 7,130,561 | B2 * | 10/2006 | Iikura et al. | 399/111 |
| 7,174,116 | B2 * | 2/2007 | Ikebata | 399/111 |
| 2004/0009008 | A1 * | 1/2004 | Park et al. | |
| 2008/0145095 | A1 * | 6/2008 | Hoshi et al. | 399/111 |
| 2009/0142092 | A1 * | 6/2009 | Sato | 399/111 |
| 2013/0259519 | A1 * | 10/2013 | Mori et al. | 399/111 |

FOREIGN PATENT DOCUMENTS

| | | |
|---|---|---|
| CN | 101950148 | 1/2011 |
| JP | 2005-242068 | 9/2005 |
| JP | 2006-267402 | 10/2006 |

OTHER PUBLICATIONS

U.S. Appl. No. 13/590,473, filed Aug. 21, 2012, Chuanyi Yang, et al.
Office Action issued Feb. 7, 2014, in Chinese Patent Application No. 201110244985.9 (with English-language Translation).
Office Action issued Aug. 26, 2014, in Chinese Patent Application No. 201110244985.9 (with English-language Translation).
Office Action issued Feb. 2, 2015, in Chinese Patent Application No. 201110244985.9 (with English-language Translation).

* cited by examiner

*Primary Examiner* — David Gray
*Assistant Examiner* — Laura Roth
(74) *Attorney, Agent, or Firm* — Oblon, McClelland, Maier & Neustadt, L.L.P.

(57) ABSTRACT

The present invention provides an image forming apparatus and a photoreceptor cartridge usable in the image forming apparatus. The image forming apparatus comprises a chamber part, right and left side walls, a first guide groove, a second guide groove, an accessory plate that is a first operation unit, and a writing unit that is a second operation unit. The photoreceptor cartridge comprises a first guide axle, a second guide axle, a first surface and a second surface. A distance between a groove opening of the first guide groove and the accessory plate is shorter than a distance between the second guide axle and the first surface, and a distance between a groove opening of the second guide groove and the writing unit is shorter than a distance between the first guide axle and the second surface.

6 Claims, 6 Drawing Sheets

IMAGE FORMING APPARATUS INCLUDING GUIDE GROOVES AND A PHOTORECEPTOR CARTRIDGE INCLUDING GUIDE AXLES

BACKGROUND OF THE INVENTION

1. Field of the Invention

The present invention relates to an image forming apparatus and a photoreceptor cartridge usable in such an image forming apparatus.

2. Description of the Related Art

The image forming apparatus including a facsimile machine, a printer, a scanner and a multifunction machine is a kind of office equipment that is widely used in daily office work. Such an image forming apparatus forms an image by using a photoreceptor cartridge, and if the toner in the photoreceptor cartridge runs out, it is necessary to replace the photoreceptor cartridge in time so as to ensure normal operation of the image forming apparatus; on the other hand, if the image forming apparatus is to be maintained, it is often necessary to remove or insert the photoreceptor cartridge.

The photoreceptor cartridge is usually removed from or inserted into the image forming apparatus by riding on two guide axles. In order to prevent mis-insertion of the photoreceptor cartridge in the process of insertion of the photoreceptor cartridge, it is common to use a method in which a guide axle first inserted into the image forming apparatus is formed thicker than a guide axle subsequently inserted of the two guide axles on the photoreceptor cartridge, and a guide groove corresponding to the guide axle first inserted (hereinafter referred to as "first insert guide groove") is formed thicker than a guide groove corresponding to the guide axle subsequently inserted (hereinafter referred to as "subsequently insert guide groove") in the image forming apparatus. That is to say, both of the guide axle subsequently inserted into the image forming apparatus and the subsequently insert guide groove corresponding thereto are relatively thin; therefore, this method is capable of preventing mis-insertion in the process of insertion of the photoreceptor.

Furthermore, there is another method for preventing the mis-insertion of the photoreceptor cartridge, and more concretely, in this method a projection part is provided near the guide axle first inserted, and the projection part has a larger diameter than the guide axle subsequently inserted, so that, it is capable of preventing mis-insertion of the photoreceptor.

However, the above-mentioned two methods can prevent only mis-insertion of the guide axle first inserted of the photoreceptor cartridge, and cannot effectively prevent mis-insertion of the guide axle subsequently inserted. The reason for this is that in the above-mentioned two methods, the first insert guide groove opened on the image forming apparatus is relatively thick and the subsequently insert guide groove is relatively thin, so that the guide axle for subsequent insertion may be inserted into the guide groove for first insertion, causing mis-insertion. In this case, it is necessary to perform a secondary operation to correct the mis-insertion, that is, to remove the photoreceptor and insert it again.

In this way, the operation of insertion becomes complex, the operation becomes inefficient, and the operability becomes worse. On the other hand, it is often necessary to push the photoreceptor into the image forming apparatus with a certain acting force when the photoreceptor cartridge is inserted; therefore, if a mis-insertion takes place in the process of the insertion and an acting force is applied accidentally, it may be easy to cause a break in or damage to the guide axle, or even to the photoreceptor cartridge.

SUMMARY OF THE INVENTION

The present invention is made in light of the above problems, and has an object to provide an image forming apparatus and a photoreceptor cartridge usable in the image forming apparatus that are capable of effectively preventing the mis-insertion of the photoreceptor cartridge and improving operability and efficiency.

According to a first aspect of the present invention, there is provided an image forming apparatus in which a photoreceptor cartridge is removably inserted, comprising: a chamber part for housing the photoreceptor cartridge; right and left side walls provided on right and left sides of the chamber part; two first guide grooves that are provided on the right and left side walls and have upturned groove openings, respectively; two second guide grooves that are provided on the right and left side walls, have upturned groove openings and are located in front of the first guide grooves, respectively; a first operation unit which is located on the back side of the chamber part that is the side of the first guide grooves; and a second operation unit which is located on the front side of the chamber part that is the side of the second guide grooves, wherein the photoreceptor cartridge comprises: a first guide axle inserted in the first guide grooves through the groove openings of the first guide grooves; a second guide axle inserted in the second guide grooves through the groove openings of the second guide grooves; and first and second surfaces wherein the first surface is facing the first operation unit and the second surface is facing the second operation unit in the process of the removal and insertion of the photoreceptor cartridge, wherein a distance between a groove opening of the first guide groove and the first operation unit is shorter than a distance between the second guide axle and the first surface.

According to the image forming apparatus of the present invention, it is capable of effectively preventing the mis-insertion of the photoreceptor cartridge, finishing the operation such as replacement of the photoreceptor cartridge by only one operation, and improving operability and efficiency of the operation.

Alternatively, in the image forming apparatus, a distance between the groove opening of the second guide groove and the second operation unit is shorter than a distance between the first guide axle and the second surface.

Alternatively, the image forming apparatus further comprises: a first position limit part that is located on the first guide grooves at the side opposite the second guide grooves, and limits the position of the first surface of the photoreceptor cartridge in the process of insertion; and a second position limit part that is located on the second guide grooves at the side opposite the first guide grooves, and limits the position of the second surface of the photoreceptor cartridge in the process of insertion, wherein a distance between the groove openings of the first guide grooves and the first position limit is shorter than a distance between the second guide axle and the first surface.

Alternatively, in the image forming apparatus, a distance between the groove opening of the second guide grooves and the second position limit part is shorter than a distance between the first guide axle and the second surface.

Alternatively, the image forming apparatus further comprises an accessory plate and a writing unit, and the chamber part is located between the accessory plate that is the first operation unit and the writing unit that is the second operation unit.

According to the above image forming apparatus, it is capable of reducing the design limit of the image forming apparatus, for example, it is capable of having two guide grooves with a same width; therefore, the quality of fit between the image forming apparatus and the photoreceptor cartridge is improved, productivity of the image forming apparatus is improved, and imaging quality of the image forming apparatus is improved.

Furthermore, according to a second aspect of the present invention, there is provided a photoreceptor cartridge usable in the above image forming apparatus.

According to the photoreceptor cartridge of the present invention, it is capable of effectively preventing the misinsertion of the photoreceptor cartridge, finishing the insertion operation of the photoreceptor cartridge without the secondary operation, and improving operability of the operation such as replacement of the photoreceptor cartridge and efficiency of the operation.

Alternatively, the photoreceptor cartridge includes a photoreceptor, and the first guide axle and the photoreceptor are coaxial.

Alternatively, in the photoreceptor cartridge, the second guide axle is thinner than the first guide axle, if the second guide axle is first inserted in the process of insertion of the photoreceptor cartridge.

Alternatively, the photoreceptor cartridge further comprises a developing unit, a photoreceptor unit and a panel connecting the developing unit to the photoreceptor unit, and the guide axle corresponding to the developing unit of the two guide axles is provided on the panel.

According to the above photoreceptor cartridge, it is capable of improving the quality of fit between the image forming apparatus and the photoreceptor cartridge, thereby improving quality of a formed image. Furthermore, it is capable of reducing the design limit of the photoreceptor cartridge, for example, it is capable of having two guide axles with a same thickness of the photoreceptor cartridge, thereby improving productivity of the photoreceptor cartridge.

DETAILED DESCRIPTION OF THE PREFERRED EMBODIMENTS

Hereinafter, embodiments of the image forming apparatus and the photoreceptor cartridge usable in said image forming apparatus according to the present invention will be concretely illustrated with reference to the drawings. However, it should be noted that embodiments illustrated as follows are just examples, and the present invention is not limited to these embodiments, but numerous modifications could be made thereto by those people skilled in the art without departing from the basic concept and technical scope of the present invention.

Furthermore, in the present invention, in the state where the photoreceptor cartridge is inserted into the image forming apparatus, two sides opposing in an axis direction of the guide axle of the photoreceptor cartridge are illustrated as "right and left sides" of the image forming apparatus; a side of insertion direction of the photoreceptor cartridge is illustrated as "front side" of the image forming apparatus, and the corresponding direction is illustrated as "forth"; a side of removal direction of the photoreceptor cartridge is illustrated as "back side" of the image forming apparatus, and the corresponding direction is illustrated as "back"; the removal direction of the photoreceptor cartridge is illustrated as "upper back" of the image forming apparatus, thus "upper" of the image forming apparatus can be clearly defined. It should be noted that the above terms such as "right and left sides", "front side", "back side", "forth", "back" and "upper", etc., are just used to clearly and briefly illustrate, and the scope of the present invention is not limited to these terms.

Figure 1:
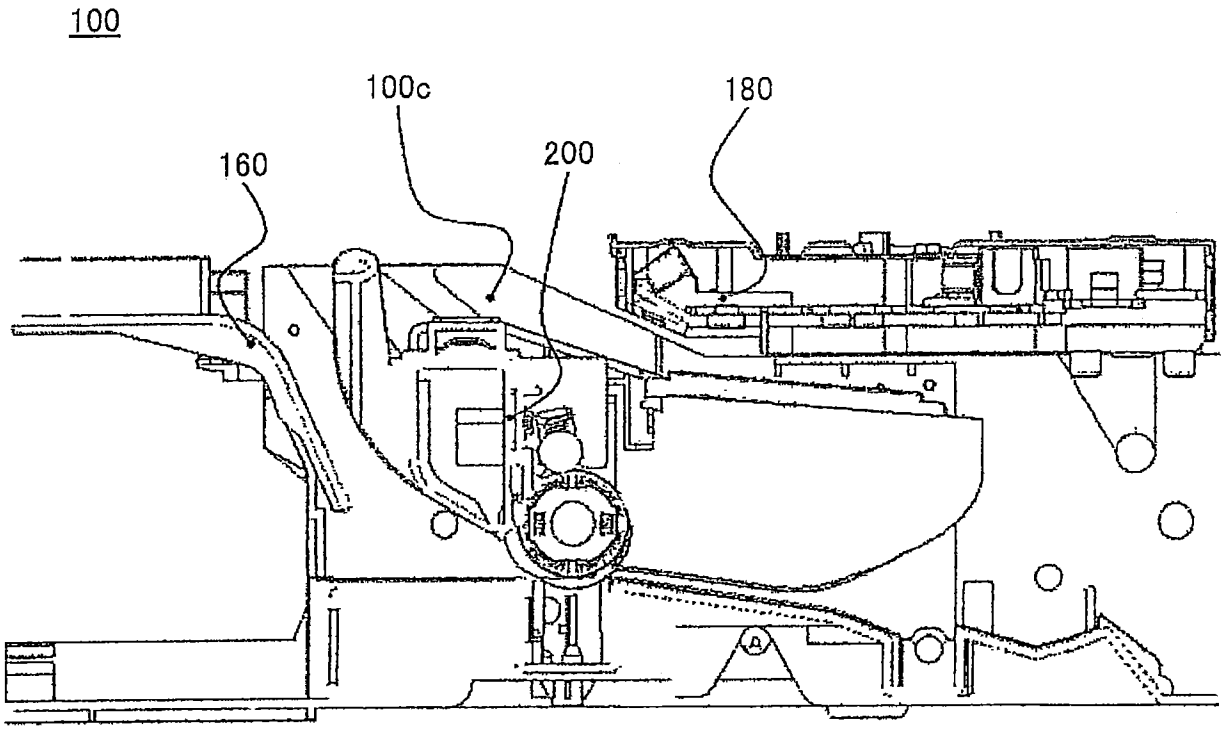
FIG. 1 is a schematic diagram illustrating a first embodiment of the image forming apparatus and the photoreceptor cartridge usable in said image forming apparatus according to the present invention.
Figure 2:
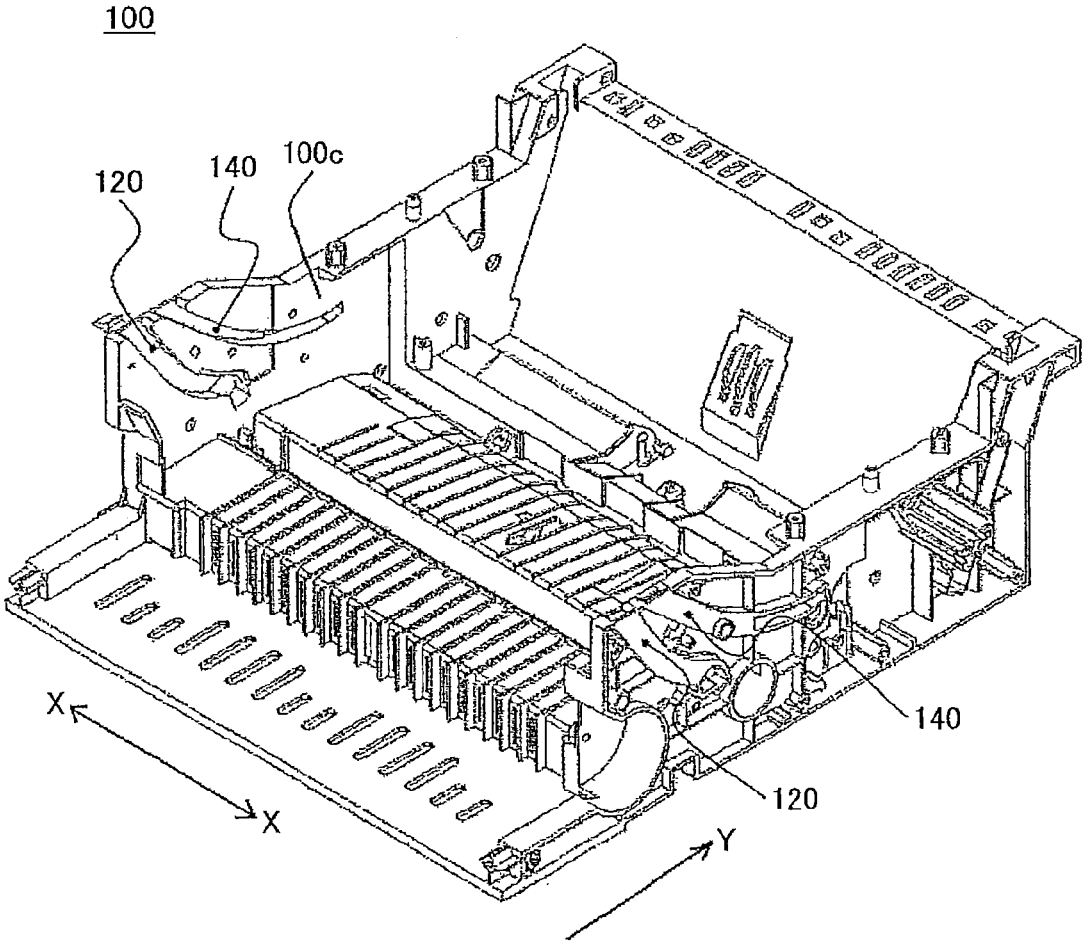
FIG. 2 is a perspective diagram illustrating the image forming apparatus according to the first embodiment of the present invention.
Figure 3:
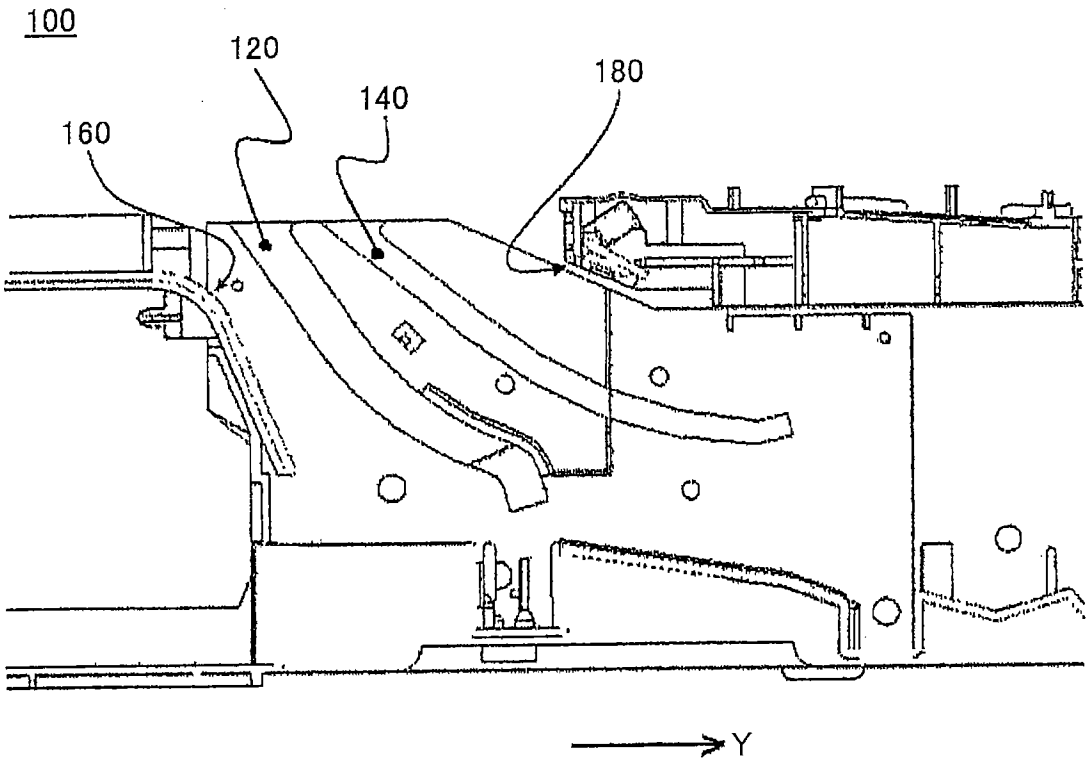
FIG. 3 is a side view illustrating the image forming apparatus according to the first embodiment of the present invention.
Figure 4:
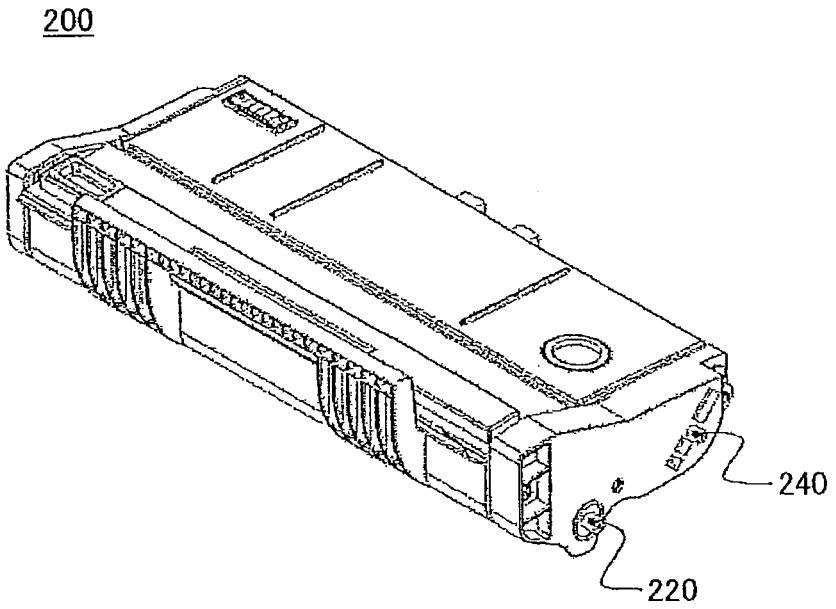
FIG. 4 is a perspective diagram illustrating the photoreceptor cartridge according to the first embodiment of the present invention.
Figure 5:
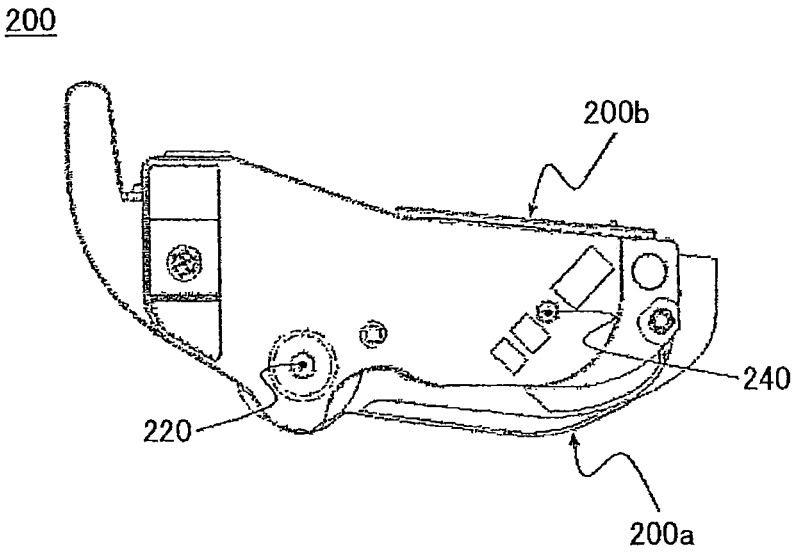
FIG. 5 is a side view illustrating the photoreceptor cartridge according to the first embodiment of the present invention.

FIG. 1 is a schematic diagram illustrating a state in which a photoreceptor cartridge 200 is inserted into an image forming apparatus 100 in the first embodiment of the present invention. FIG. 2 is a perspective diagram illustrating the image forming apparatus 100 according to the first embodiment of the present invention, and the illustrations of an accessory plate 160 that is a first operation unit and a writing unit 180 that is a second operation unit of the first embodiment are omitted so as to clearly illustrate a chamber part housing the photoreceptor cartridge 200. FIG. 3 is a side view illustrating the image forming apparatus 100 corresponding to FIG. 2. FIG. 4 is a perspective diagram illustrating the photoreceptor cartridge 200, and FIG. 5 is a side view illustrating the photoreceptor cartridge 200 corresponding to FIG. 4.

In the first embodiment, the image forming apparatus 100 includes the chamber part, right and left side walls 100*c*, 100*c*, first guide grooves 120, second guide grooves 140, the accessory plate 160 that is the first operation unit and the writing unit 180 that is the second operation unit. The photoreceptor cartridge 200 includes a first guide axle 220, a second guide axle 240, a first surface 200*a* and a second surface 200*b*. Furthermore, a distance between groove openings of the first guide grooves 120 and the accessory plate 160 that is the first operation unit is shorter than a distance between the second guide axle 240 and the first surface 200*a* in the image forming apparatus 100. The photoreceptor cartridge 200 can be removed from or inserted into the image forming apparatus 100.

Specifically, as illustrated in FIG. 1, FIG. 2 and FIG. 3, in the present embodiment, the chamber part of the image forming apparatus 100 is used to house the photoreceptor cartridge 200 removably inserted into the image forming apparatus 100.

The right and left side walls 100*c*, 100*c* are provided on right and left sides of the chamber part, namely, two sides opposing each other on an axis direction of the first guide axle 220 (or the second guide axle 240) in the state where the photoreceptor cartridge 200 is inserted into the image forming apparatus 100. In the present embodiment, the right and left side walls 100*c*, 100*c* are side walls opposing each other in direction X illustrated in FIG. 2. In addition, in the perspective diagram as illustrated in FIG. 2, only one symbol of the side walls is marked, because only one of the side walls can be illustrated.

Two first guide grooves 120 opposing each other are provided on the right and left side walls 100*c*, 100*c* respectively, and have upturned groove openings for the insertion of the first guide axle 220 as illustrated in FIG. 2.

The second guide grooves 140 also have upturned groove openings for the insertion of the second guide axle 240 as illustrated in FIG. 2. Additionally, the two second guide grooves 140 opposing each other are provided on the right and left side walls 100*c*, 100*c* and are located in front of the first guide grooves 120, respectively. In the present embodiment, as illustrated in FIG. 2, the second guide grooves 140 are located at the direction Y side of the corresponding first guide grooves 120, that is to say, the direction from the first guide groove 120 to the second guide groove 140 is the same to the insertion direction of the photoreceptor cartridge 200.

The accessory plate 160 is located on the back side of the chamber part, namely, the side of the first guide grooves 120. The image forming apparatus 100 may generate heat in operation, therefore it is capable of preventing the spread of heat and guiding a cooling air current by the accessory plate 160 in the present embodiment, thereby preventing influence of heat on image quality. In the present embodiment, the accessory plate 160 is used as the first operation unit.

The writing unit 180 for writing is located on the front side of the chamber part, namely, the side of the second guide grooves 140. In the present embodiment, the writing unit 180 is used as the second operation unit.

Furthermore, as illustrated in FIG. 1, FIG. 4 and FIG. 5, in the present embodiment, the photoreceptor cartridge 200 includes a developing unit and a photoreceptor unit, and the photoreceptor cartridge 200 is inserted into the image forming apparatus 100 in the order from the developing unit to the photoreceptor unit.

The first guide axle 220 corresponding to the developing unit is configured to protrude from two side surfaces opposing each other, and be inserted in the first guide grooves 120 through the groove openings of the respective first guide grooves 120. That is to say, in the present embodiment, the first guide axle 220 is a guide axle subsequently inserted.

The second guide axle 240 corresponding to the photoreceptor unit is configured to protrude from the two side surfaces opposing each other, and be inserted in the second guide grooves 140 through the groove openings of the respective second guide grooves 140. That is to say, in the present embodiment, the second guide axle 240 is a guide axle first inserted. Additionally, in the present embodiment, the second guide axle 240 parallels the first guide axle 220; however, the present invention is not limited to that, so long as the photoreceptor cartridge 200 can be removed from and inserted into the image forming apparatus 100 smoothly.

The first surface 200*a* is facing the accessory plate 160 that is the first operation unit in the processes of removal and insertion of the photoreceptor cartridge 200.

The second surface 200*b* is facing the writing unit 180 that is the second operation unit in the processes of removal and insertion of the photoreceptor cartridge 200.

According to the above configured image forming apparatus 100 and the photoreceptor cartridge 200, they are capable of preventing mis-insertion of the guide axle first inserted, namely, the second guide axle 240.

Preferably, in a variation of the present embodiment, a distance between the groove openings of the second guide grooves 140 and the writing unit 180 that is the second operation unit is shorter than a distance between the first guide axle 220 and the second surface 200*b*. According to the above configured image forming apparatus 100 and the photoreceptor cartridge 200, they are capable of preventing mis-insertion of the guide axle subsequently inserted, namely, the first guide axle 220.

Accordingly, they are capable of preventing not only mis-insertion of the second guide axle 240 but also mis-insertion of the first guide axle 220; therefore, they are capable of effectively ensuring that the photoreceptor cartridge 200 can be inserted into the image forming apparatus 100 correctly while bringing convenience to an operator.

Figure 6:
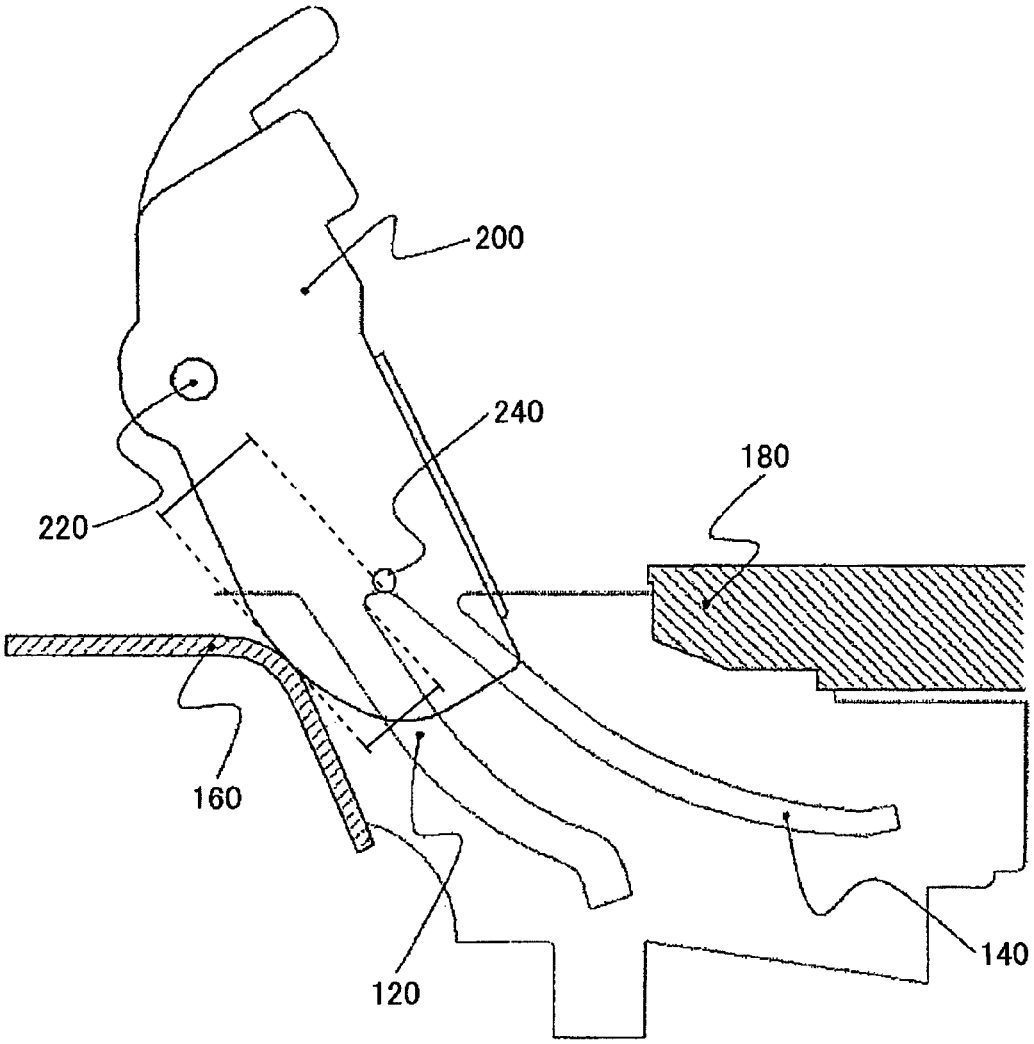
FIG. 6 is a schematic diagram illustrating a state in which the photoreceptor cartridge according to the first embodiment of the present invention is being inserted.
Figure 7:
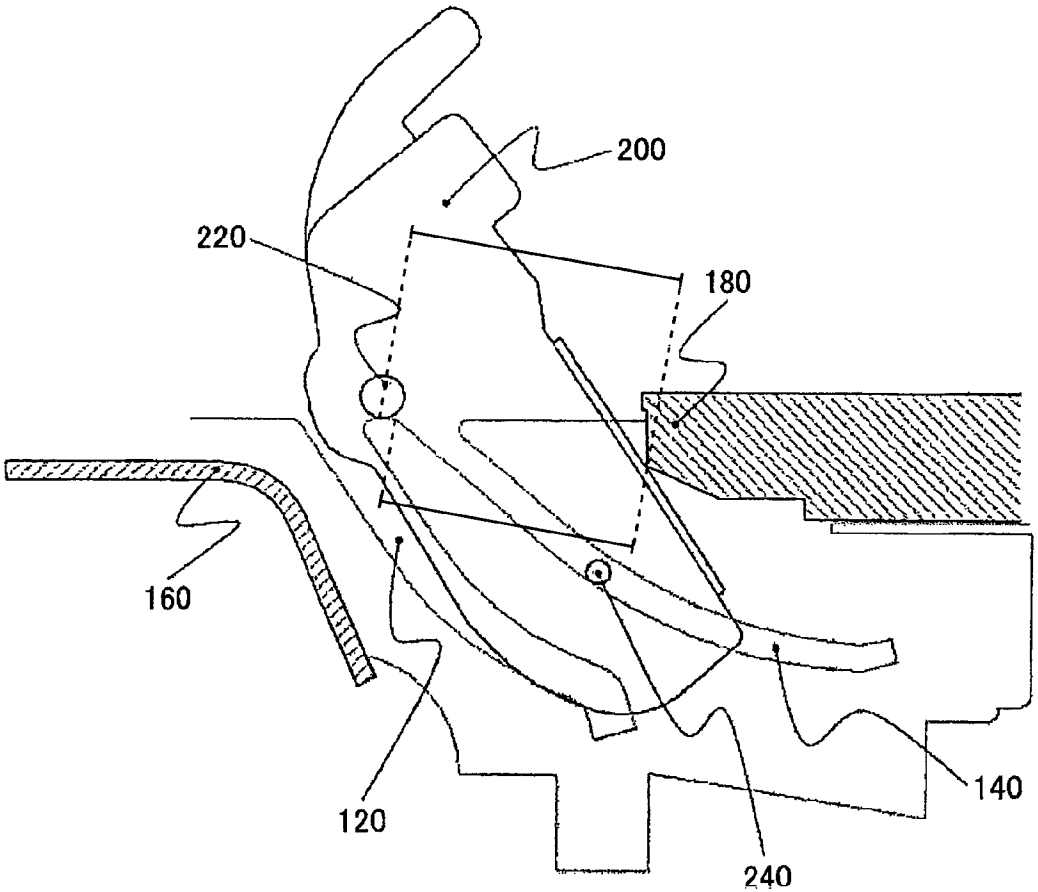
FIG. 7 is another schematic diagram illustrating another state in which the photoreceptor cartridge according to the first embodiment of the present invention is being inserted.

FIG. 6 is a schematic diagram illustrating the state in which the second guide axle 240 of the photoreceptor cartridge 200 is being inserted; FIG. 7 is a schematic diagram illustrating the state in which the first guide axle 220 is being inserted, after inserting the second guide axle 240 of the photoreceptor cartridge 200 into the second guide grooves 140 correctly.

In what follows, an insertion operation of the above configured image forming apparatus 100 and photoreceptor cartridge 200 will be illustrated with reference to FIG. 6 and FIG. 7.

As illustrated in FIG. 6, in the process of the operation of the second guide axle 240, the maximum degree of the backward (in a direction opposite to arrow Y in FIG. 2) shift of the first surface 200*a* of the photoreceptor 200 is that the first surface 200*a* comes into contact with the accessory plate 160 (the first operation unit), that is to say, the accessory plate 160 limits the back location of the photoreceptor cartridge 200. Meanwhile, the distance between the second guide axle 240 of the photoreceptor cartridge 200 and the first surface 200*a* of the photoreceptor cartridge 200 is longer than the distance between the groove opening of the first guide groove 120 provided on the image forming apparatus 100 and the accessory plate 160; therefore, the second guide axle 240 of the photoreceptor cartridge 200 cannot be inserted into the groove openings of the first guide grooves 120. Accordingly, because of this structure, it is possible to prevent mis-insertion of the second guide axle 240 effectively and reliably.

As illustrated in FIG. 7, in the process of the operation of the first guide axle 220, the maximum degree of the forward (in a direction of arrow Y in FIG. 2) shift of the second surface 200*b* of the photoreceptor 200 is that the second surface 200*b* comes into contact with the writing unit 180 (the second operation unit), that is to say, the writing unit 180 limits the forth location of the photoreceptor cartridge 200. Meanwhile, the distance between the first guide axle 220 of the photoreceptor cartridge 200 and the second surface 200*b* of the photoreceptor cartridge 200 is longer than the distance between the groove opening of the second guide groove 140 provided on the image forming apparatus 100 and the writing unit 180; therefore, the first guide axle 220 of the photoreceptor cartridge 200 cannot also be inserted into the groove openings of the second guide grooves 140. Accordingly, because of this structure, it is possible to prevent mis-insertion of the first guide axle 220 effectively and reliably.

Preferably, in the photoreceptor cartridge 200, the photoreceptor unit includes a photoreceptor provided with a photosensitive drum, and the photoreceptor cartridge 200 is configured so that the first guide axle 220 corresponding to the photoreceptor unit and the photoreceptor are coaxial. The positional accuracy of the guide axle corresponding to the photoreceptor unit (in present embodiment, it is the first guide axle 220) is an important factor in determining the quality of the formed image; therefore, according to the structure, the photoreceptor unit, especially the photosensitive drum has a better positional accuracy, thereby forming an image with better effect.

In particular, in the photoreceptor cartridge 200, the developing unit is connected to the photoreceptor unit through a panel, and the guide axle corresponding to the developing unit (in present embodiment, it is the second guide axle 240) is provided on the panel. Accordingly, it is easy to produce the photoreceptor cartridge 200, that is to say, productivity of the photoreceptor cartridge 200 is improved.

Preferably, in the present invention, the guide axle first inserted (in the present embodiment, it is the second guide axle 240) may be thinner than the guide axle subsequently inserted (in the present embodiment, it is the first guide axle 220). The reason for this is that mis-insertions of the guide axles are prevented by the above structure of the image forming apparatus 100 and the photoreceptor cartridge 200 usable in the image forming apparatus 100; therefore, thickness of the guide axles is not limited. In particular, the diameter of the guide axle first inserted (in the present embodiment, it is the second guide axle 240) may be equivalent to the diameter of the guide axle subsequently inserted (in the present embodiment, it is the first guide axle 220). By this way, the limitation on thickness of the guide axles is eliminated, and therefore, the requirement on design performance is met and the productivity is improved.

In particular, in the image forming apparatus 100 according to the present embodiment, the chamber part that houses the photoreceptor cartridge 200 is located between the accessory plate 160 and the writing unit 180, namely, the chamber part is composed of the accessory plate 160, the writing unit 180 and the right and left side walls 100*c*, 100*c*, etc. Accordingly, in the present embodiment, the accessory plate 160 is the first operation unit, and the writing unit 180 is the second operation unit. However, the first and second operation units may be chosen according to the actual needs in practical applications and they are not limited to the example illustrated in the present embodiment, because image forming apparatuses and their structures are many and varied.

Furthermore, in another embodiment of the present invention, the image forming apparatus 100 further includes a first position limit part 160 and a second position limit part 180. Additionally, a distance between the groove openings of the first guide grooves 120 and the first position limit part is shorter than a distance between the second guide axle 240 and the first surface 200*a*. Accordingly, the second guide axle 240 cannot be inserted into the first guide grooves 120, thereby preventing the mis-insertion effectively.

The first position limit part 160 is located on the back side of the chamber part, namely, one side of the first guide grooves 120 (the side opposite the second guide grooves 140), and limits the back (the direction opposite to arrow Y in FIG. 2) position of the first surface 200*a* of the photoreceptor cartridge 200 in the process of insertion.

The second position limit part 180 is located on the front side of the chamber part, namely, one side of the second guide grooves 140 (the side opposite the first guide grooves 120), and limits the front (the direction of arrow Y in FIG. 2) position of the second surface 200*b* of the photoreceptor cartridge 200 in the process of insertion.

Preferably, a distance between the groove openings of the second guide grooves 140 and the second position limit part 180 is shorter than a distance between the first guide axle 220 and the second surface 200*b*. Accordingly, the first guide axle 220 cannot be inserted into the second guide grooves 140, thereby preventing the mis-insertion effectively.

The present (second) embodiment can be implemented according to the above illustration with reference to the drawings of the first embodiment; therefore, here the corresponding drawings and detailed illustration are omitted.

In addition, in the present embodiment, shape, quantity, specific location, etc., of the position limit parts are not specially limited. For example, the shape of the position limit parts 160, 180 may be hemispherical or tabular, etc., so long as the location of the photoreceptor cartridge 200 can be limited so as to prevent the mis-insertions of the guide axles.

In the above two embodiments, the photoreceptor cartridge 200 having the developing unit and the photoreceptor unit is inserted into the image forming apparatus 100 in the order from the developing unit to the photoreceptor unit. However, the present invention is not limited to that; similarly, the structure of the present invention may be configured to insert the photoreceptor cartridge 200 into the image forming apparatus 100 in the order from the photoreceptor unit to the developing unit. Because this structure is similar to the above embodiments and it is easy to understand for those people skilled in the art that it is possible to implement this structure according to the above illustration, repeated explanation here is omitted.

To sum up, according to the image forming apparatus and the photoreceptor cartridge usable in said image forming apparatus, they are capable of preventing not only the mis-insertion of the guide axle first inserted but also the mis-insertion of the guide axle subsequently inserted. They are capable of finishing the insertion operation such as replacement of the photoreceptor cartridge without the secondary operation and improving operability of the insertion operation and efficiency of the operation, thereby making it easier for an operator to replace the photoreceptor cartridge. In addition, the structure of the present invention is simple and it is easy to implement, and the implementation cost is relatively low even when it is applied to modification on an existing type machine.

Furthermore, according to the present invention, the design limitation on the image forming apparatus and the photoreceptor cartridge, such as the requirement on width of the guide grooves of the image forming apparatus, the requirement on thickness of the guide axles of the photoreceptor cartridge, etc., are eliminated. It is generally known that the positional accuracy of the photoreceptor unit is an important factor in determining the quality of formed images, and the guide axles corresponding to the photoreceptor unit subsequently inserted are often relatively thin in prior art. Therefore, it easily leads to reduced positional accuracy of the photoreceptor unit, thereby leading to reduced quality of the formed image. In contrast, the structure of the present invention can preferably solve the problem, and the productivity of the photoreceptor cartridge is improved.

Herein, the present invention is illustrated with reference to the embodiments; however, it should be apparent that the present invention is not limited to the specifically disclosed embodiments, and variations and modifications may be made without departing from the scope of the present invention.

The present application is based on Chinese Priority Application No. 201110244985.9 filed on Aug. 25, 2011, the entire contents of which are hereby incorporated herein by reference.

What is claimed is:

1. An image forming apparatus in which a photoreceptor cartridge is removably inserted, comprising:

a chamber part for housing the photoreceptor cartridge;

right and left side walls provided on right and left sides, respectively, of the chamber part;

two first guide grooves that are provided on the right and left side walls and have upturned groove openings, respectively;

two second guide grooves that are provided on the right and left side walls, have upturned groove openings and are located in front of the first guide grooves, respectively; wherein end portions of the first guide grooves are vertically lower than the second guide grooves and the second guide grooves extend further in the horizontal direction than in the vertical direction;

a first operation unit which is located on a back side of the chamber part that is the side of the first guide grooves; and a second operation unit which is located on a front side of the chamber part that is the side of the second guide grooves, wherein the photoreceptor cartridge includes a first guide axle inserted in the first guide grooves through the groove openings of the first guide grooves, a second guide axle inserted in the second guide grooves through the groove openings of the second guide grooves, and first and second surfaces wherein the first surface is facing the first operation unit and the second surface is facing the second operation unit in processes of removal and insertion of the photoreceptor cartridge, wherein a distance between the groove openings of the first guide grooves and the first operation unit is shorter than a distance between the second guide axle and the first surface, wall parts are provided between the first guide grooves and the second guide grooves, and a length between the second guide axle and a contact part of the first surface in contact with the first operation unit is such that the second guide axle contacts with at least one of the wall parts and the first surface contacts with the first operation unit.

2. The image forming apparatus according to claim 1, wherein a distance between the groove opening of the second guide groove and the second operation unit is shorter than a distance between the first guide axle and the second surface and a length between the first guide axle and a contact part of the second surface in contact with the second operation unit is such that the first guide axle contacts with at least one of the wall parts and the second surface contacts with the second operation unit.

3. The image forming apparatus according to claim 1, further comprising:

an accessory plate and a writing unit, wherein the chamber part is located between the accessory plate that is the first operation unit and the writing unit that is the second operation unit.

4. The image forming apparatus according to claim 1, wherein the photoreceptor cartridge includes a photoreceptor, and the first guide axle and the photoreceptor are coaxial.

5. The image forming apparatus according to claim 1, wherein the second guide axle is inserted prior to the first guide axle in a process of insertion of the photoreceptor cartridge and the second guide axle is thinner than the first guide axle.

6. The image forming apparatus according to claim 5, wherein the photoreceptor cartridge further comprises a developing unit, a photoreceptor unit and a panel connecting the developing unit to the photoreceptor unit, and the guide axle corresponding to the developing unit of the two guide axles is provided on the panel.

* * * * *